United States Patent [19]

Longenecker

[11] 4,146,742

[45] Mar. 27, 1979

[54] ELECTRIC FURNACE HAVING A SIDE WALL TO ROOF SMOKE HOLE MOUNTING

[76] Inventor: Levi S. Longenecker, 61 Mayfair Dr., Pittsburgh, Pa. 15228

[21] Appl. No.: 867,281

[22] Filed: Jan. 5, 1978

[51] Int. Cl.[2] ..... F27D 1/02

[52] U.S. Cl. ..... 13/35; 110/335; 266/280

[58] Field of Search ..... 13/32, 35; 266/280, 266/281; 432/65, 72, 238; 110/335

[56] References Cited

U.S. PATENT DOCUMENTS

| | | | |
|---|---|---|---|
| 2,742,023 | 4/1956 | Reintjes | 110/335 X |
| 3,018,096 | 1/1962 | Rydinger | 110/335 X |

*Primary Examiner*—R. N. Envall, Jr.

*Attorney, Agent, or Firm*—Parmelee, Miller, Welsh & Kratz

[57] ABSTRACT

An electric furnace roof having spaced-apart, inner and outer, cooling-fluid-circulating refractory tile or block-carrying metal ring structures is provided with an upwardly offset, outwardly extending, roof ledge segment which, with an aligned, cooperating furnace side wall segment defines a smoke hole open portion to the furnace. The side wall segment of the furnace wall, with the roof segment, also provides an inner smoke chest that is open to the smoke hole portion, and has an upwardly enlarged funnel shape, and is metal reinforced. The roof segment is provided with a cooling water circulating loop system which may be independent of cooling means supplying inner and outer, radially spaced-apart, metal ring structures of the roof. The roof is adapted to be raised and lowered as a unit in a conventional manner with respect to the furnace wall and to be swung to one side thereof for scrap-charging and maintenance purposes. The inner ring structure provides a support or mounting for a roof crown portion, and the inner and outer ring structures provide a support or mounting for a brim portion thereof.

In one embodiment, refractory tile members are carried in a suspended relation in the roof crown portion, and in another embodiment, refractory tile members are carried in a sprung relation therewithin. In the one embodiment, the inner ring structure carries a liftable inner ring which is adapted to rest on an overhead frame and to carry the crown portion of the roof.

26 Claims, 13 Drawing Figures

Tower

ELECTRIC FURNACE HAVING A SIDE WALL TO ROOF SMOKE HOLE MOUNTING

BACKGROUND OF THE INVENTION

1. Field of the Invention

This invention relates to an improved electric arc furnace construction and to a liftable furnace roof from which the smoke hole hood is eliminated, and in which a side segment of the roof cooperates with a side segment of the furnace wall to provide a smoke chest and indirectly, a smoke hole. Another phase of the invention deals with a furnace roof which may be raised and swung-off the furnace as a unit, and which has a central crown portion which may be raised and swung for maintenance and repair independently of its outer or brim portion.

2. DESCRIPTION OF THE PRIOR ART

Heretofore, it has been customary to provide an electric arc furnace roof, not only with a central area for bypassing the electrodes, but also with a hood which defines a smoke hole portion and, in effect, further defines a smoke chest. Such a construction is advantageous from the standpoint of removing exhaust gases from the highest point of the furnance, but has disadvantageous features of materially increasing the height and complexity of the roof construction, and of maximizing initial cost and maintenance or repair expense. Also, such a hood has a tendency to increase the temperature to which the roof is subjected at the exhaust area and thus, to complicate the application of supporting and load carrying metal structure as well as the protective cooling thereof.

A roof hood, in addition to increasing the overall weight of the furnace roof, lends inflexibility to the construction from the standpoint of, for example, preventing an off-centered positioning of its central electrode area or crown. Operating experience has indicated that the hottest portion of an electric furnace is normally the portion adjacent the roof-manipulating metal tower. Flexibility in the construction of the roof is thus desirable in order to permit the central electrode hole carrying or crown portion thereof to, if desired, be offset backwardly from the tower.

SUMMARY OF THE INVENTION

It has thus been an object of the invention to provide an improved electric arc furnace construction and particularly, one having a roof of lessened overall weight to facilitate its handling.

Another object has been to devise an electric furnace construction which eliminates the need for providing its roof with a smoke hood that is solely carried thereby.

Another object of the invention has been to provide a furnace construction having enlarged head room in its chamber, particularly adjacent its roof covering.

Another object has been to provide an improved furnace roof that may be moved into and out of position with respect to a ledge of the furnace side wall as an overall unit, and that has a central or crown portion that is normally subjected to the greatest wear and tear so constructed and positioned that it may be independently raised and lowered with respect to an outer or brim portion thereof.

A further object of the invention has been to provide an improved electric arc furnace construction in which entrance to its smoke hole portion is defined between aligned roof and side wall nose segments.

A still further object has been to provide a furnace construction wherein the portion of its roof which serves to receive and bypass the electrodes therethrough may be given a backward offset in the roof assembly to thus more evenly distribute the heat generated within the furnace and avoid concentrating it adjacent its operating tower.

Figure 12:
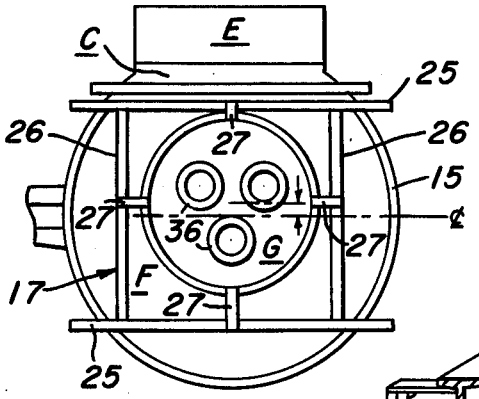

And, FIG. 12 is a greatly reduced plan view showing how the normal centrally aligned crown portion of a furnace roof may be offset backwardly or away from the metal tower side thereof, as facilitated by the provision of a smoke hole that is defined primarily by the ledge portion of the furnace side wall and cooperates with an aligned segment of the roof.

DESCRIPTION OF THE PREFERRED EMBODIMENTS

Figure 1:
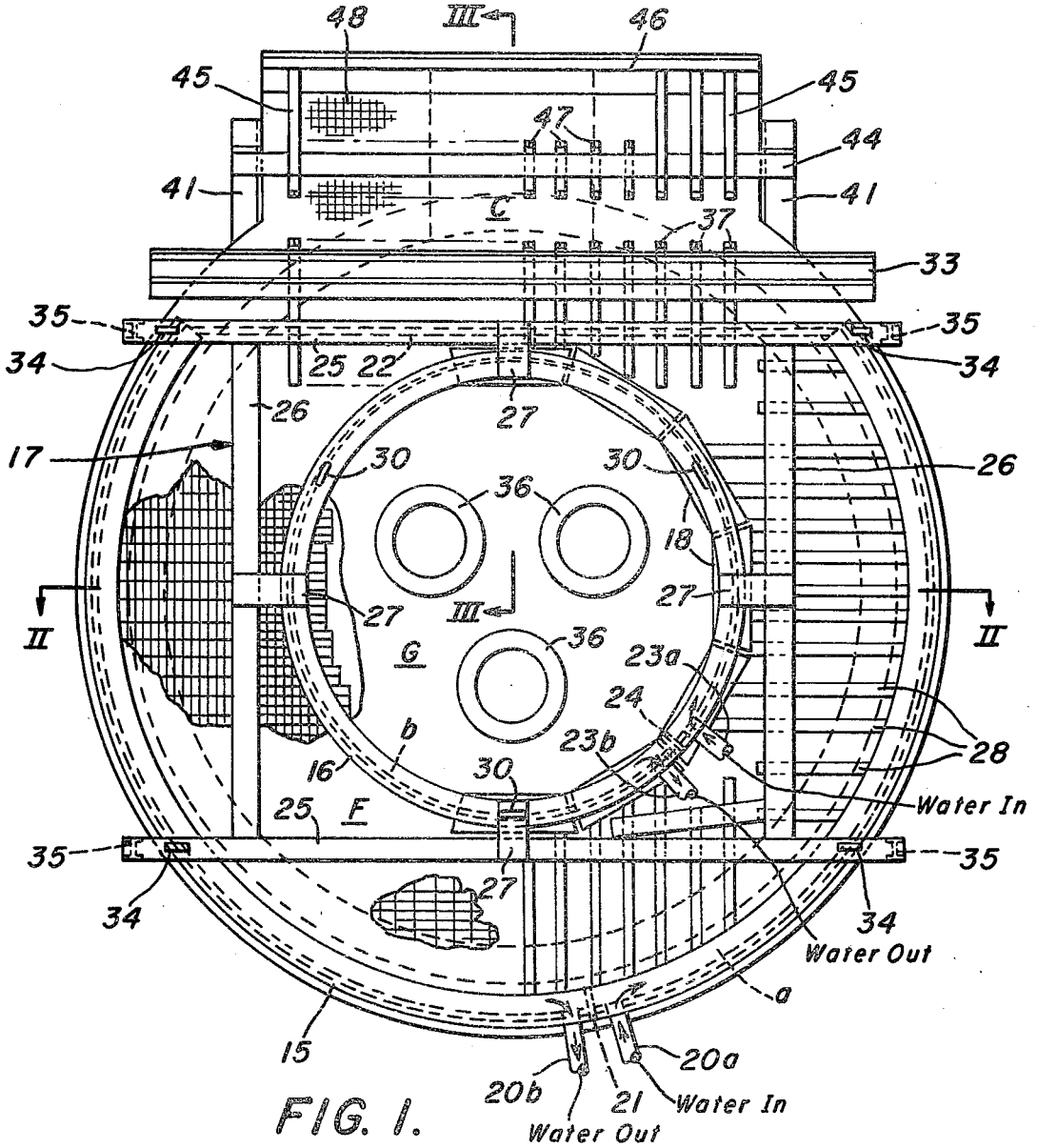
FIG. 1 is a top plan view of a furnace constructed in accordance with the invention, showing a roof provided with a suspended refractory brim portion and a sprung refractory crown portion.
Figure 2:
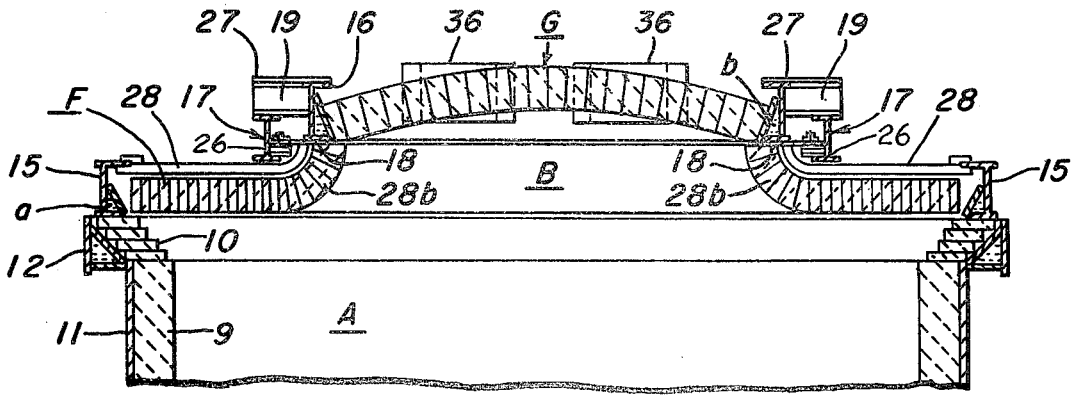
FIG. 2 is a vertical section on the scale of and taken along the line II—II of FIG. 1.

Referring particularly to the embodiment of FIGS. 1 to 7, inclusive, I have shown a full, circular roof B for conventional unitary lifting and swingable positioning with respect to an upper, open-mouth defining flange or ledge portion 10 of a refractory side wall 9 of an electric arc, metal-melting furnace A. The furnace A has an outer, upright supporting metal frame or shell structure 11 thereabout with a surmounting, annular metal bezel 12 secured thereto to provide a reinforcing outer ring-life support for the ledge portion 10. As shown in FIG. 2, the bezel 12 may be in the form of an angular-shaped ring that projects outwardly from the metal frame or shell structure 11 to support refractory blocks of the ledge portion 10 in their outwardly enlarged, stepped positioning on the lip of refractory side wall 9. The outwardly upwardly diverging or funnel-shape of the ledge portion 10 provides the furnace with an upwardly enlarged diameter, open-mouth chamber area which not only facilitates the use of a segment thereof for cooperating with the roof B to define a smoke or fume chest D and an exhaust hole portion E, but also desirably, increases head room of the furnace chamber and enables slag fume upon condensing, to flow back from a smoke chest D into the furnace chamber. That is, the sizeable area of smoke chest D will catch a considerable volume of the slag vapor which, when condensed, will desirably drain back into the furnace A.

Although the use of a funnel-shaped ledge portion 10 has also been found to be advantageous in a conventional roof construction in which the smoke hole is provided by an upwardly projecting hood carried by the roof, it is particularly important where, as shown in the drawings of the present application, a segment C of the furnace wall is to cooperate with an aligned side segment of the roof to provide for smoke or fume exhaust. As indicated from the drawings, the smoke chest D and indirectly, the smoke hole portion E, are defined along their sides and bottom (three sides) by a furnace nose segment and along their top by aligned roof segment C. The open smoke hole portion E is directly defined by a refractory ring 40 carried by the furnace side wall. See particularly FIGS. 3 and 5.

As shown in FIGS. 1 and 2, the roof B has an outer brim portion F of a suspended refractory tile construction, and a central innermost area or crown portion G of a sprung refractory tile construction. An outer metal ring 15 has a partition therealong to define a cooling fluid or water flow passageway a, as supplied through an inlet 20*a* and as exhausted on an opposite side of a baffle 21 in the form of warmed water through outlet 20*b*. Since a back portion of the ring 15 has notched or cut-out end portions to provide for the smoke hole roof nose or segment C, such back end portions are shown connected by a cross-extending pipe member 22 (see FIGS. 1 and 3) that extends along underneath a back-positioned crossbeam 25 of an overhead, rectangular support frame 25, 26. This enables a continuous flow of cooling fluid 17 of members or water along the outer ring 15. An inner, liftable metal ring structure 16, shown in FIG. 4 of I-beam shape, has a partition-defining fluid or water-cooled, continuous passageway b therealong. As shown particularly in FIG. 1, cooling fluid or water may be supplied to the passageway b through an inlet connection 23*a* and exhausted on the other side of a baffle 24 through an outlet connection 23*b*.

Figure 4:
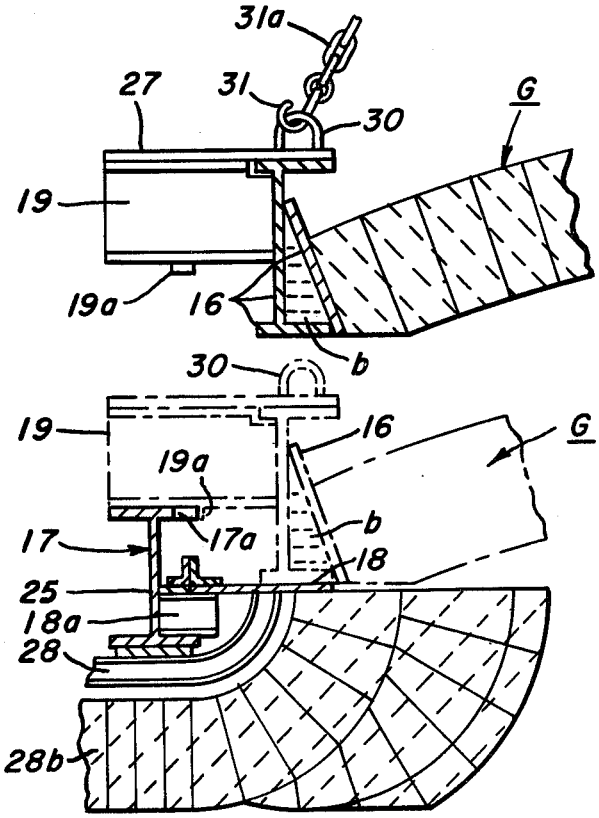
FIG. 4 is a further enlarged fragmental side section in elevation showing details of an interfitting and lift-off relationship between brim and crown portions of the roof construction of FIG. 2; this figure further illustrates how the crown portion thereof may be lifted out of and lowered into an interfitting aligned relation with the brim portion thereof.
Figure 4A:
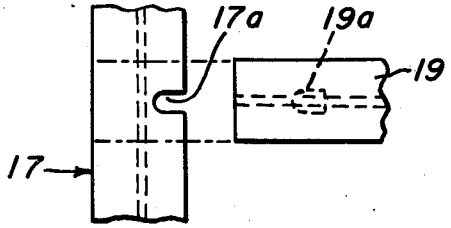
FIG. 4A is an enlarged fragmental plan view illustrating aligning tongue and groove portions of cooperating parts of an inner ring structure of the roof that is separable as illustrated in FIG. 4.

As shown particularly in FIGS. 1, 4 and 4A, the upper flange of the I-beam shaped ring 16 has a group of quadrant-positioned, short-length plates 27 secured thereon; each plate 27 carries a short length, reinforcing beam 19 that is adapted to cooperate with and rest on a top flange of an adjacent beam 25 and 26 of overhead supporting frame 17. It will be noted that each short-length beam 19 carries a latch-alignment lug 19*a* on its lower flange to slidably fit within an open-end slot or groove 17*a* in the top flange of the adjacent beam member 25 or 26. A series of horizontal so-called retaining plates 18 are shown secured (see FIGS. 1 and 4) by means of pieces 18*a* to extend inwardly from the underside of the lower flanges of the beams 25 and 26 to hold buck stays down when the ring structure 16 is to be lifted-off the frame 25, 26, and to provide a further support for the ring 16 when the crown G is being carried in-place with respect to the brim portion F of the roof F.

Refractory crown portion or central area G which is carried by the ring 16 may be independently lifted-off the frame 25, 26 through the agency of lift loops, ears or eyelets 30, a hook 31 and a chain 31*a* of an overhead lifting device, such as a lift arm, hoist or the like. In this manner, the innermost or crown portion G of the roof may be independently lifted-off the outermost brim portion F thereof for separate repair and maintenance. This is particularly advantageous, since it has been determined, by way of example, that the brim portion F may have a separate lift of about 250 heats before first repair where suspended basic or refractory tile members are employed, as compared to about 125 heats for the crown portion G that is without a smoke hole defining hood subjected to corrosive gases.

Since the crown portion G may be separately removed, its refractories may be partially or completely replaced before any need for repair of the brim portion F. When the roof B is placed on a repair rack, possibly only the nose or smoke hole segment C thereof which faces the electrodes will need to be replaced. It appears that the substantially two-thirds to three-quarters of the roof area represented by the roof brim portion F between the smoke hole nose or segment C and the outer water-cooled ring 15 may have a life of about 500 heats before a complete refractory tile and partial hanger casting replacement is required. By reason of the elimination of the use of a roof carried exhaust hood, which also results in a lessened weight on the furnace side wall, the side wall furnace usage life may also be increased up to about 250 heats.

If a service life of 500 heats is required to use up all the refractories in the lesser wear areas of the full or combination roof B, then the schedule may be two crown repairs to one-third brim repair, and then two more crowns to a complete brim repair. A conventional high aluminum (Hi-Al) refractory type of sprung dome roof, to make about 500 heats, requires at least eight roof changes in which the full roof weight of, for example, 100,000 pounds must be lifted. However, to make 500 heats using my brim and crown roof construction will require only two individual lifts of the crown G thereof and only two for the full roof, for a total of four changes. This results in a considerable saving of energy and a better refractory yield, as furthered by the use of a so-called furnace side wall provided smoke hole and chest.

Figure 11:
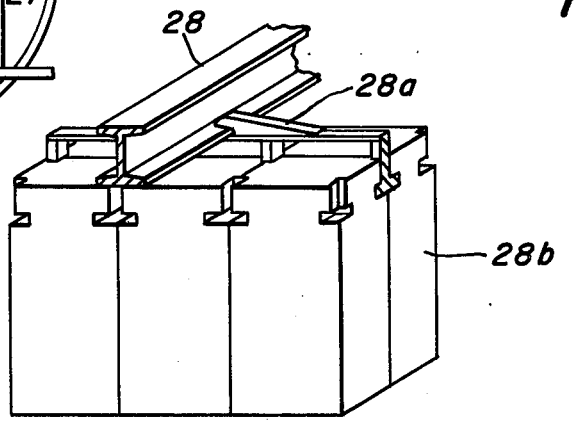
FIG. 11 is a perspective representative view in elevation illustrating a typical hanger mounting of refractory tile members on a roof beam using a suspended type of construction.
Figure 6:
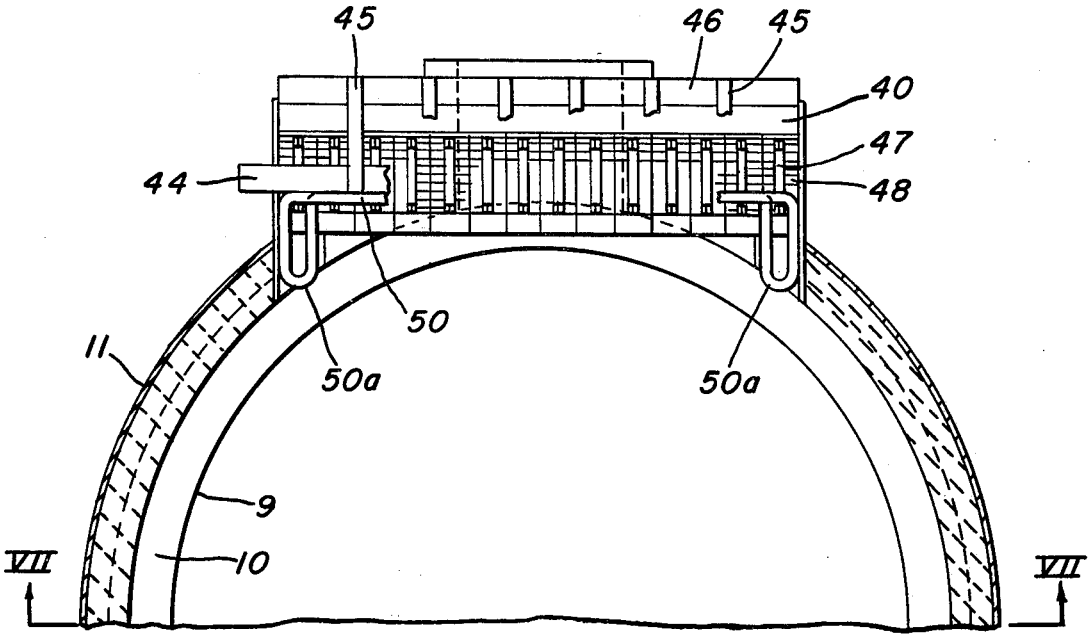
FIG. 6 is a half section plan on the scale of FIGS. 1 and 2, particularly showing the construction of an outwardly extending segment of the roof which cooperates with an aligned wall segment of the furnace to define a smoke chest and exhaust hole portion, see also the view of FIGS. 3 and 5.
Figure 7:
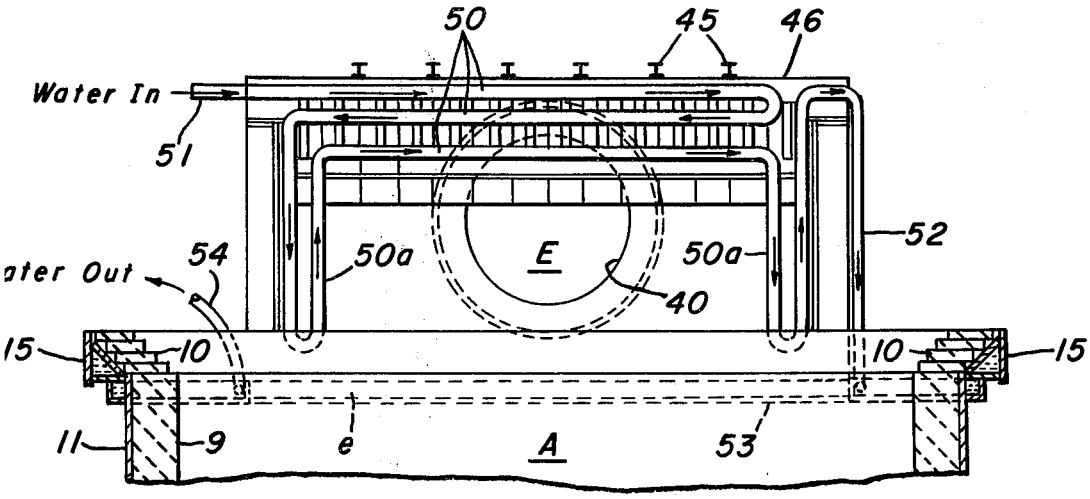
FIG. 7 is a fragmental section in elevation, taken along the line VII—VII of FIG. 6, and showing an end view of the roof and wall segments and a tubular, hairpin, water-cooling piping system that is carried by the wall segment to cooperate and define a parting line with the roof segment.

The full roof B is supported by a continuous overhead, rectangular metal frame structure 17 which includes front and back, transversely-extending spaced-apart I-beams 25 and sidewise spaced-apart, longitudinally-extending I-beams 26 which, at their outer end portions, rest upon and are secured to the outer ring 15. As shown particularly in FIG. 1, the front and back cross members 25 of the overhead metal support frame 17 are, at their opposite end portions, connected to the outer metal ring 15, and at their central or mid portions are connected by the plates 27 to the inner ring structure; line Roof hanger beams 28 (see FIGS. 1 and 4) extend between the outer ring 15 and the retainer plates 18 of the inner ring structure to carry conventional hanger castings, such as 28*a* for suspending refractory tile members 28*b*. See also FIGS. 2 and 11.

Figure 3:
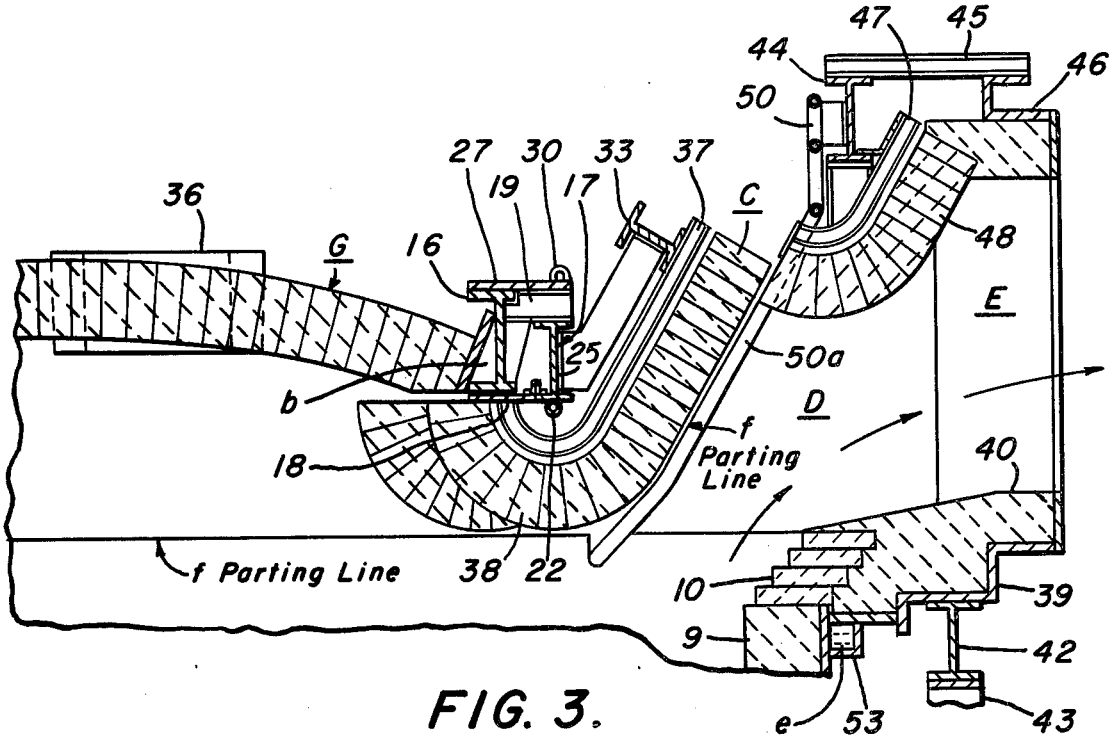
FIG. 3 is a slightly enlarged fragmental section in elevation taken along the line III—III of FIG. 1, and particularly illustrating the construction of aligned segments of the roof and of the ledge portion of a side wall of the furnace which, in cooperation, provide a fume exhaust or smoke hole portion and a smoke chest.

With reference to the crown portion G of the roof B, its refractory tile members are shown in FIG. 3 mounted in a sprung relation to extend from inner or secondary ring 16. As shown in FIGS. 1 and 2, the crown G is provided with a group of refractory, electrode-receiving, opening-defining rings 36. Retaining plates 18, see FIGS. 1 to 4, inclusive, are shown mounted in a segmented, round extending, mounted relation along the frame structure 25, 26 to serve as a primary inner ring-like supporting bumper assembly, protect the break nosing, provide a parting line and a further fixed support for the inner, secondary ring 16 for the crown portion G of the roof B. The frame members 25, 26 have four upright, end-positioned, leg extensions 35 (see FIG. 1) that provide "off" furnace floor supports and that may be used for "on" furnace supports to reduce loading pressure on the furnace wall 9.

Figure 5:
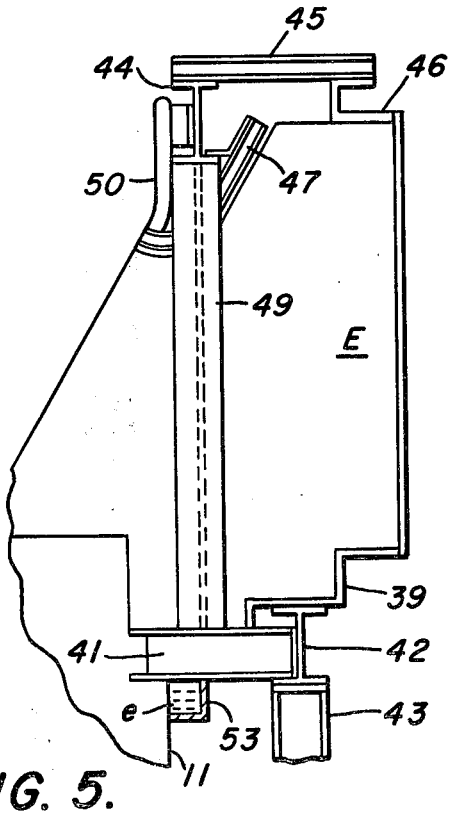
FIG. 5 is a fragmental view in elevation showing details of the side construction of associated cooperating portions of fume or exhaust handling aligned nose segments of the roof and of a side wall ledge of the furnace.

Referring particularly to FIGS. 3 and 5, inclusive, I have illustrated smoke hole defining roof nose segment C which cooperates with an aligned segment of the ledge 10 of the furnace side wall 9. This roof nose segment C is back-positioned from the standpoint of the conventional lift and swivel tower (see FIGS. 16 and 18 of my U.S. Pat. No. 3,967,048), and enables the withdrawal of furnace smoke or fume from under the roof B instead of through it. The crown portion G has, as shown, refractory tiles sprung within the secondary ring 16 and about the refractory, electrode-receiving, hole-defining rings 36. The smoke hole roof nose segment C has, as shown in FIGS. 3 and 4, refractory tiles 38 carried by hanger castings and angular-shaped hanger beams 37 (in the manner illustrated in FIG. 11 for another portion of the roof). It will be noted that the beams 37 are spaced-apart and secured at their ends between plates 18 and a cross-extending I-beam member 33. The beam 33 is secured at its ends (see FIG. 1) on backwardly extending portions of side frame members 36. Loops or hanger rod clips 34 are also shown mounted adjacent opposite ends of the front and back, cross-extending frame member 25 for use (not shown, but illustrated in my above-mentioned patent) in connecting the overhead frame to a pair of side arms of a conventional lift and swing mechanism. They thus may be used when the entire furnace roof B is to be lifted.

It will be noted that the roof nose segment C is shown in FIGS. 3, 5, 6 and 7 as adapted to be fluid or water-cooled, by a looped or hair-pin type of pipe or tube assembly or unit 50 which is carried by an aligned, cooperating ledge or side wall portion of the furnace A that constitutes its nose portion. The assembly 50 has an inlet 51 and an outlet leg 52 that may be separately connected to a cold water supply system. The assembly 50 is located adjacent a side, such as the back side, of the furnace structure, as carried over the outer end of an upwardly offset, refractory-tile-defined nose portion or segment 48 of the furnace side wall which defines smoke chest D and smoke hole portion E.

The tubular assembly 50 is shown looped in front of the tile nose segment 48 and, at its ends, is shown provided with looped legs 50*a* along sides of supporting metal structure which defines a rectangular type of opening at the smoke chest D to the furnace. After water has been circulated along the assembly 50, it may then be exhausted through a down-extending, side leg 52 which is shown connected to one end of a fluid-jacket-defining, box-like, cross-extending hollow metal member 53. The member 53, see particularly in FIG. 7, extends along the inside of the furnace side wall adjacent its opening and, at its ends has an outlet 54 for exhausting warmed fluid or water to the cooling system.

As shown particularly in FIGS. 3 and 5, the tubular assembly 50 serves to define a parting line f with respect to the under-face of the refractory tile members 38 of the roof nose segment C which, in turn, defines the upper side of the smoke chest D in cooperation with the sides and base of tile assembly 48 of the nose segment of the furnace side wall whose refractory ring 40 provides smoke hole or exhaust portion E. The tile members of the assembly 48 are carried in a conventional manner, such as illustrated with respect to the tiles 28*b* of FIG. 11, by hanger castings and spaced-apart, angle-shaped supporting beams 47. The beams 47 are secured to the bottom flange of a cross-extending I-beam 44 which is positioned backwardly of a refractory ring portion 40 of the furnace wall which encircles the smoke hole portion E.

As illustrated in FIGS. 1, 3 and 5, the beam 44 carries on its upper flange a pair of backwardly extending, side channels 45 which at their back ends are secured on a cross-extending metal channel piece 46. The channel piece 46 is an extension of outwardly stepped, metal supporting structure for refractory ring 40 that defines the smoke hole E. As particularly shown in FIG. 5, a pair of upwardly extending, spaced-apart, side-positioned, upright beams 49 are secured to support the cross beam 44 on its under-flange and, in turn, at their lower ends are carried on a pair of short-length, horizontal, cross-extending beams 41. The beams 41 rest upon and are secured to a bottom flange of a cross-extending I-beam 42 on which a stepped, side supporting metal structure 39 rests. The beam 42 is, in turn, supported at its underflange on a pair of upright, side-mounted beams 43 of the outer frame or shell structure of the furnace side wall 9.

Figure 10:
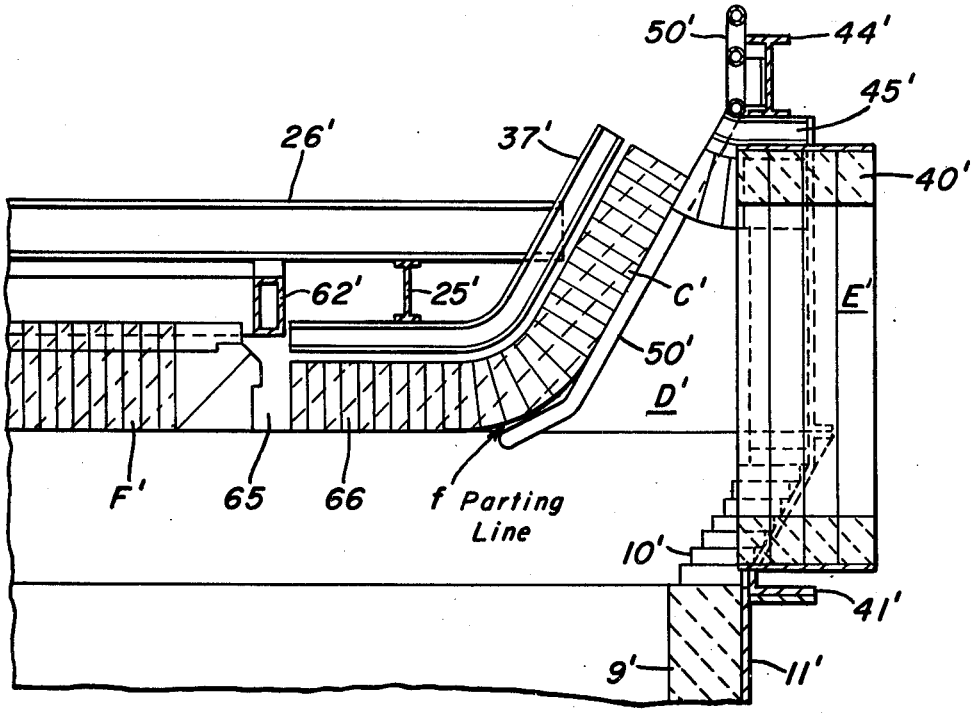
FIG. 10 is an enlarged fragmental side section in elevation through steam chest and smoke hole portions of the furnace construction of FIGS. 8 and 9, particularly illustrating the construction of aligned nose segments of the roof and of a furnace side wall ledge portion.
Figure 8:
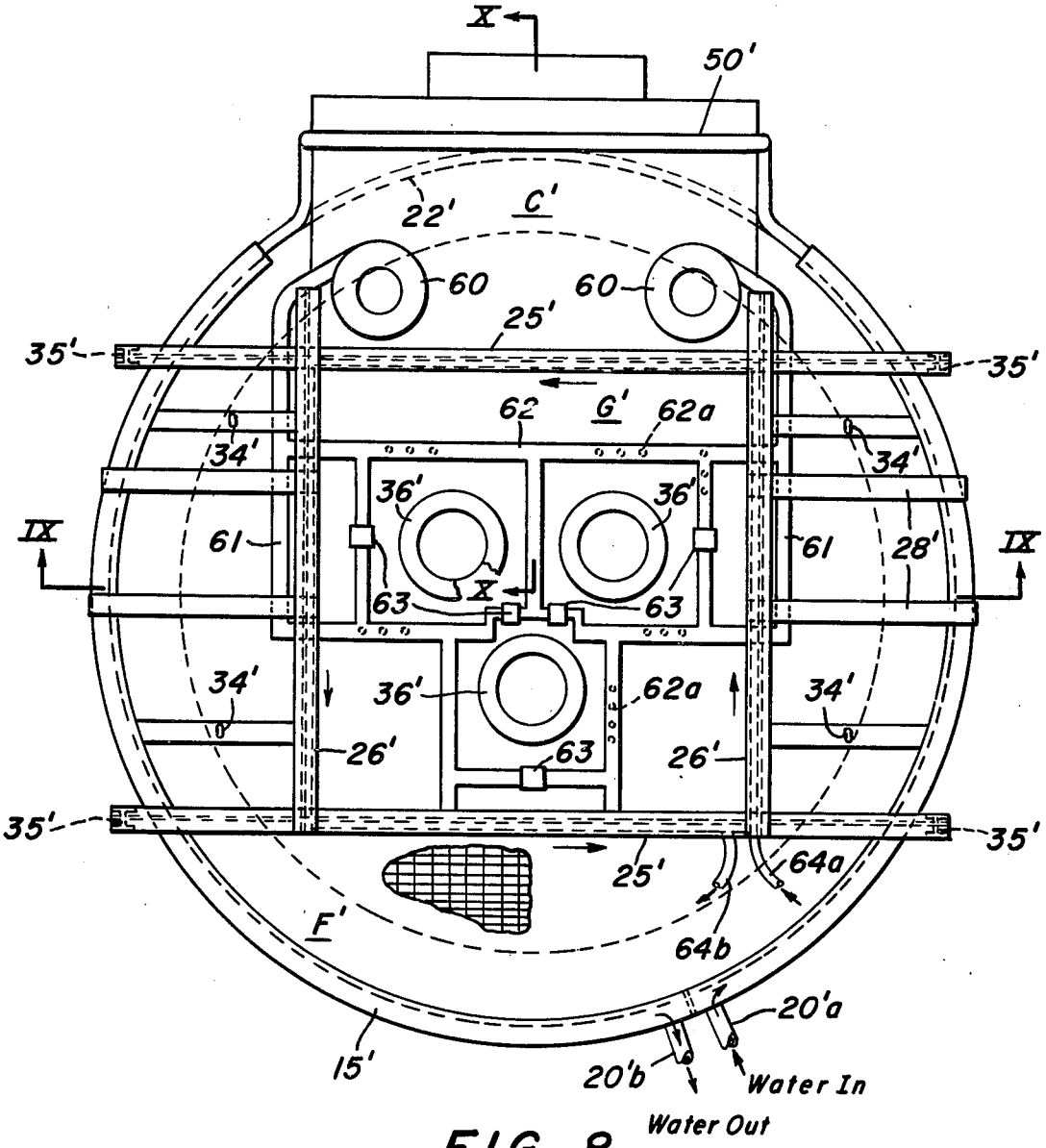
FIG. 8 is a top plan view of a modified form of a furnace roof construction in which refractory crown and brim portions thereof are both carried in a suspended relation by metal ring structure; also, as distinguished from the embodiment of FIG. 1, an air cooling duct system is shown for applying cooling air about electrode hole portions within the refractory crown of the roof.
Figure 9:
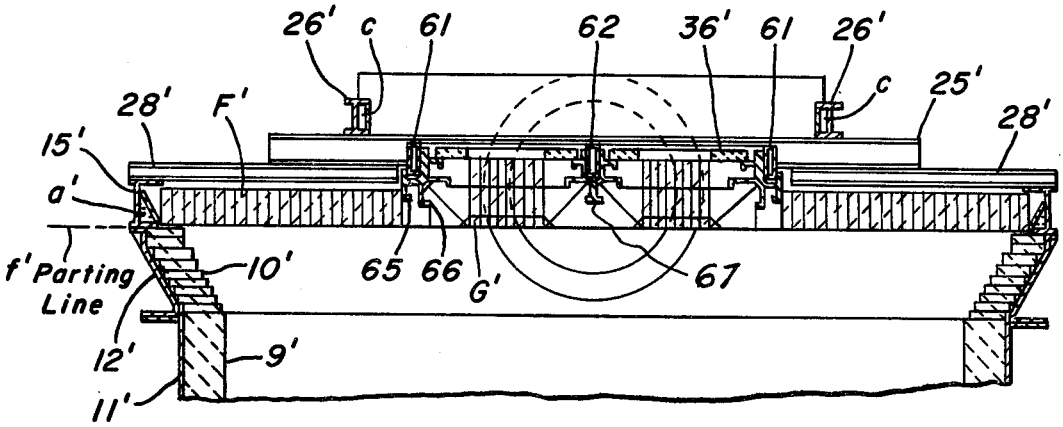
FIG. 9 is a vertical fragmental section on the same scale as and taken along line IX—IX of FIG. 8.

FIGS. 8, 9 and 10 illustrate a modified embodiment in which, for simplicity of illustration, I have indicated parts of generally similar construction and employment with those of the first embodiment by the same reference numerals but with prime affixes. Additional structure that is not generally illustrated in the first embodiment is indicated by new reference numerals.

Referring particularly to FIGS. 8 and 9, crown portion G′ is shown as of a suspended rather than sprung type, and as carried on a hollow metal, box channel assembly or system, represented as 62. The system 62 is employed to supply cooling air through outlet orifices or holes 62*a* therealong about or in a surrounding relation with respect to refractory electrode hole defining rings 36′. Cooling air may be supplied, as shown in FIG. 8, by blowers 60 carried on the roof B′ to one side of the smoke hole nose segment C′; the blowers supply cooling air along side duct members 61 to the assembly 62. The assembly 62 is assembled and secured to the overhead frame structure 25′, 26′ in a manner similar to that illustrated in FIGS. 6, 9, 10 and 11 of my U.S. Pat. No. 4,063,028 of Dec. 13, 1977.

As shown in FIG. 9, the refractory tile members of the central or crown portion G′ are carried by suitable multi-leg hanger castings, such as 65, 67. It would be noted that the branches of the air supply system 62 are connected by electrically non-conductive connectors 63. As in the first described embodiment, the smoke hole and chest are primarily defined by the side wall or ledge portion of the furnace, itself, and as cooled by a water-circulating tubular system 50′. FIGS. 8 to 10, inclusive, thus illustrate a roof having a suspended crown portion G′ of a construction in which both its brim portion F′ and its crown portion G′ have refractories carried in a suspended relation. This indicates that the concept of using the furnace, itself, to provide the main portions (three sides) of a smoke chest D′ and to substantially fully provide the smoke hole E′, and that the concept of providing the furnace side wall with an outwardly enlarged funnel-shaped ledge 10′ are important features that may be advantageously applied to suspended as well as sprung roof constructions.

I claim:

1. An improved electric furnace construction having an upright side enclosing wall defining a furnace chamber and a two-part roof adapted to be lowered and lifted into and out of position with respect to the upright side wall which comprises, an upper ledge along the side wall, an outer metal roof ring adapted to rest on said ledge, an inner metal roof ring structure in a radially inwardly spaced relation with respect to said outer ring, an overhead metal support frame connected to said outer ring and surrounding and supporting said inner ring structure with respect to said outer ring, a first group of refractory tile members carried between said outer ring and said inner ring structure to define a roof brim, a second group of refractory tile members carried within and by said inner ring structure to define a central roof crown that has spaced-apart electrode hole portions therein, said overhead frame having a cross-extending metal member, a refractory roof nose segment extending from said roof brim and supported on said cross-extending metal member of said support frame, said outer ring having a pair of spaced-apart portions connected to opposite end portions of said cross-extending metal member adjacent said roof nose segment, and the side enclosing wall having a wall nose portion in an aligned spaced under-positioned relation with said roof nose segment to define a smoke chest portion therewith that is open beneath the roof to the furnace chamber.

2. A furnace construction as defined in claim 1 wherein, said ledge is defined about the side wall of the furnace by refractory members of an upwardly diverging funnel shape, and an outer metal frame structure is positioned in a supporting relation along said funnel-shaped ledge.

3. A furnace construction as defined in claim 1 wherein, said roof nose segment is upwardly offset with respect to said roof brim and projects outwardly beyond said outer ring in a cooperating spaced relation above said aligned wall nose portion.

4. An improved furnace as defined in claim 1 wherein said outer ring and said inner ring structure have fluid-cooled jackets therealong.

5. A furnace construction as defined in claim 1 wherein said cross-extending metal member is connected substantially centrally thereof to said inner ring structure.

6. A furnace construction as defined in claim 1 wherein, said pair of spaced-apart portions of said outer ring are opposite terminal end portions thereof, and said cross-extending metal member connects said opposite terminal end portions of said outer ring together.

7. A furnace construction as defined in claim 1 wherein a metal nose-carrying structure extends outwardly from and is carried by said cross-extending metal member.

8. A furnace construction as defined in claim 6 wherein, said outer ring member is provided with water jacketing, and a cross-extending conduit member is connected between said opposite terminal end portions of said outer ring member for providing a continuous flow of cooling fluid therealong.

9. A furnace construction as defined in claim 8 wherein, said cross-extending conduit member is carried by and along said cross-extending metal member of said overhead frame.

10. A furnace construction as defined in claim 1 wherein, said overhead metal support frame has a second cross-extending member in a forwardly spaced relation with respect to said first-mentioned cross-extending member, said second cross-extending member is connected at its opposite end to said outer ring, and said support frame has a pair of spaced-apart longitudinal-extending side members connected at their opposite ends to said cross-extending members to define a substantially rectangular frame therewith.

11. A furnace construction as defined in claim 10 wherein, said cross-extending and said longitudinal-extending side members are connected substantially centrally therealong to said inner metal ring structure.

12. A furnace construction as defined in claim 1 wherein, said inner ring structure has a pair of primary and secondary inner rings that are positioned in a cooperating relation with respect to each other, said secondary ring directly carries the refractory tile members of said roof crown, and said primary ring directly with said outer ring carries the refractory tile members of said roof brim.

13. A furnace construction as defined in claim 12 wherein said primary and secondary rings have cooperating alignment means therebetween for assuring an aligned positioning of said secondary ring on and with respect to said primary ring.

14. A furnace construction as defined in claim 1 wherein, a tubular fluid-cooled assembly is carried by said wall nose portion and is positioned in a cooperating relation with said roof nose segment, and said tubular assembly defines a parting line between said wall nose portion and said roof nose segment.

15. An improved electric furnace construction having a substantially upright enclosing chamber-defining side wall and an overhead roof mounted for movement into and out of a closing-off relation with respect to the side wall which comprises, a funnel-shaped ledge carried on and about an upper end portion of the side wall, said ledge defining an upwardly enlarged open mouth portion and an enlarged furnace chamber, an outer supporting metal ring member structure for said roof, an overhead metal frame structure, an inwardly spaced metal ring member structure connected to said outer structure by said overhead metal frame structure, outer refractory tile members in a supported relationship between said inner and outer ring member structures to define an outer roof brim portion, inner refractory tile members in a supported relationship within said inner ring member structure to define an inner roof crown portion, said roof crown portion having electrode by-passing open refractory ring portions, the roof being adapted to be raised and lowered as a unit with respect to said ledge for moving said outer ring structure into and out of a resting position on said ledge, said roof having a refractory side nose extending from said inner ring structure, a furnace smoke chest having a smoke exhaust hole portion open outwardly from a side of said ledge and defined by the furnace side wall below said side nose of the roof, and said smoke chest being defined between said side nose of the roof and the side wall of the furnace.

16. An improved furnace construction as defined in claim 15 wherein, said ledge is upwardly outwardly stepped in an under-spaced relation with said side nose of the roof, and stepped metal structure is positioned along the furnace side wall to support said ledge.

17. An improved furnace construction as defined in claim 15 wherein, said side nose is upwardly outwardly offset from said roof, and said smoke exhaust hole portion is directly defined by the refractory side wall of and above said ledge of the furnace.

18. An improved furnace construction as defined in claim 15 wherein, the refractory tile members of said brim portion are mounted in a substantially planar suspended relation between said inner and outer ring member structures, and the tile members of said roof crown portion are mounted in a substantially sprung relation within said inner ring member structure.

19. An improved electric furnace construction having a substantially enclosing side wall defining a furnace chamber and an overhead roof mounted for movement into and out of a closing-off relation with respect to the side wall which comprises, a roof-receiving upper ledge on and about the upper end of the side wall of the chamber, fully cross-extending structure metal frame members defining a continuous overhead support frame, the roof having an outer supporting metal ring member and an inwardly spaced inner metal ring structure carried in a connected relation by said cross-extending structural frame members, said inner ring structure having primary and secondary metal members, outer refractory tile members in a supported relation between said primary metal member and said outer ring member to define a roof brim portion that is adapted to rest upon said ledge, said secondary metal member being adapted to liftably rest upon said primary inner ring member, inner refractory tile members in a supported relationship within said secondary metal member to define a roof crown portion, said crown portion having electrode bypassing openings therethrough, the roof being adapted to be raised and lowered as a unit with respect to said ledge for moving said outer ring member into and out of a resting position on said ledge, and said crown portion being adapted to be separately raised and lowered on said secondary metal member and with respect to said primary metal member.

20. An improved furnace construction as defined in claim 19 wherein, said outer ring member and said secondary metal member have passageways and connections for movement continuous of cooling fluid therealong.

21. An improved electric furnace construction as defined in claim 19, wherein said primary and secondary metal members have cooperating tongue and groove portions for aligning them with respect to each other and in such a manner as to enable raising and accurate lowering of said roof crown portion with respect to said roof brim portion.

22. An improved furnace construction as defined in claim 19 wherein said ledge is of an outwardly diverging funnel shape fully about the furnace chamber.

23. An improved furnace construction as defined in claim 19 wherein, a smoke hole portion is defined by an upwardly offset nose segment of the roof and an aligned portion of the furnace wall, a smoke chest portion is connected to said smoke hole portion and is defined between sand nose segment of the roof and an aligned portion of said ledge, and said smoke hole portion is enclosed by a refractory ring carried by said ledge.

24. An improved furnace construction as defined in claim 23 wherein a continuous hair-pin shaped cooling fluid piping assembly extends along top and upright sides of said smoke hole portion.

25. An improved electric melting furnace construction having an upright side enclosing wall defining a furnace chamber and a roof adapted to be lowered and lifted into and out of position with respect to the upright side wall which comprises, a funnel-shaped ledge extending fully about an upper end of the side wall and defining an outwardly-upwardly enlarged portion of the furnace chamber under the roof, said roof having an inner crown portion of metal member supported refractory tile construction and electrode by-passing hole portions therein, said roof having an outer brim portion of metal member supported refractory tile construction that is adapted to liftably rest on said ledge, and refractory member lined smoke hole and chest portions open to the furnace chamber for exhausting fumes therefrom.

26. A furnace construction as defined in claim 25 wherein, the roof has a refractory side nose, and said side nose has an offset relation above said ledge and defines said smoke hole and chest portions in combination with said ledge and an upwardly projecting portion of the furnace side wall.

* * * * *